US007698822B2

(12) United States Patent
Kostner et al.

(10) Patent No.: US 7,698,822 B2
(45) Date of Patent: Apr. 20, 2010

(54) PERSONAL CARE APPARATUS WITH AN AUTOMATICALLY PIVOTABLE HEAD PART

(75) Inventors: Johannes Kostner, Liebenfels (AT); Gerald Kauer, Ferlach (AT); Michael Janny, Klagenfurt (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 437 days.

(21) Appl. No.: 10/526,198

(22) PCT Filed: Aug. 29, 2003

(86) PCT No.: PCT/IB03/03957

§ 371 (c)(1),
(2), (4) Date: Oct. 24, 2005

(87) PCT Pub. No.: WO2004/022289

PCT Pub. Date: Mar. 18, 2004

(65) Prior Publication Data

US 2006/0107529 A1 May 25, 2006

(30) Foreign Application Priority Data

Sep. 6, 2002 (EP) ..... 02102321

(51) Int. Cl.
*B26B 19/00* (2006.01)
*B26B 19/16* (2006.01)
*B26B 19/20* (2006.01)

(52) U.S. Cl. ..... 30/216; 30/201; 30/200; 30/74; 30/43; 30/210; 30/43.92

(58) Field of Classification Search ..... 30/216, 30/201, 32, 43.92, 531, 74, 200, 220, 233, 30/49, 55, 241, 202, 43, 34.1, 210, 199, 43.1, 30/43.6, 89, 43.5, 321, 526–529, 45, 73.7; 16/111.1, 110.1; D28/44, 54, 48
See application file for complete search history.

(56) References Cited

U.S. PATENT DOCUMENTS

| | | | | |
|---|---|---|---|---|
| 1,359,031 A | | 11/1920 | Coffman | |
| 1,810,152 A | * | 6/1931 | Volz | 30/210 |
| 2,025,972 A | * | 12/1935 | Caster | 30/199 |
| 2,768,438 A | * | 10/1956 | Coggins et al. | 30/200 |

(Continued)

FOREIGN PATENT DOCUMENTS

EP 0325326 B1 7/1989

*Primary Examiner*—Ghassem Alie

(57) ABSTRACT

A personal care apparatus having a hair trimmer, a main part and a head part. The head part being connected to the main part in a region of the main part that is adjacent to the head part and is pivotable relative to the main part. A personal care tool is provided on the head part and comprising a toothed cutting mechanism that has at least one drivable toothed blade and a spring of a U-shaped configuration has a cross-member connected to the head part and two sides co-operating with at least one position extension connected to the main part in the region of each of its two sides. The spring acts between the head part and the main part, and the head part is pivotable by the spring in synchronization with varying displacing forces that act on the head part in the course of a personal care process.

2 Claims, 2 Drawing Sheets

U.S. PATENT DOCUMENTS 3,041,726 A * 7/1962 Hitson ..... 30/201
3,589,007 A * 6/1971 Walton ..... 30/140
3,797,109 A * 3/1974 Yamada et al. ..... 30/43.1
4,922,608 A * 5/1990 Pahl ..... 30/43.91
4,930,217 A * 6/1990 Wolf et al. ..... 30/43.92
4,970,784 A * 11/1990 Althaus et al. ..... 30/527
5,038,472 A * 8/1991 Iderosa ..... 30/527
5,579,581 A * 12/1996 Melton ..... 30/223
5,836,030 A 11/1998 Hazeu et al.
5,970,616 A 10/1999 Wahl et al.
5,979,060 A * 11/1999 Holzbauer et al. ..... 30/201
6,279,234 B1 * 8/2001 Chaouachi et al. ..... 30/201
6,301,786 B1 * 10/2001 Oswald et al. ..... 30/43.92
6,357,117 B1 * 3/2002 Eichhorn et al. ..... 30/43.92
6,421,922 B2 * 7/2002 Beutel et al. ..... 30/216
7,103,980 B2 * 9/2006 Leventhal ..... 30/526
2002/0000043 A1 * 1/2002 Beutel et al. ..... 30/216
2002/0092178 A1 * 7/2002 Fung ..... 30/216
2002/0162226 A1 * 11/2002 Abraham et al. ..... 30/210

* cited by examiner

PERSONAL CARE APPARATUS WITH AN AUTOMATICALLY PIVOTABLE HEAD PART

The invention relates to a personal care apparatus having a main part and a head part, wherein the main part is designed to be held in one hand and has a region adjacent the head part, wherein the head part is connected to the main part in the said region of the main part that is adjacent the head part and is pivotable relative to the main part about an axis of pivot, wherein a personal care tool is provided on the head part.

A personal care apparatus of this kind is known from U.S. Pat. No. 5,970,616 A. This known personal care apparatus is a hair trimmer. In this known hair trimmer, the head part, which has a toothed cutting mechanism as a personal care tool, can be pivoted between two operating positions, in which case the head part has to be pivoted through 180° to pivot it from one operating position to the other. In each of its two operating positions, the head part is immovably fixed in the given operating position by means of a fixing device, which means that no relative movement is possible between the head part and the main part in either of the two operating positions of the head part. In the known hair trimmer, this gives rise to the problem that, in each of the two operating positions of the head part, the position of the toothed cutting mechanism provided on the head part, and the position of the comb device which is also provided on the head part, relative to that area of the body to which care is to be applied, or in other words at which hair is to be cut (i.e. relative to the area of the head of a human being to which care is to be applied for example), is dependent on how the person concerned holds the main part, and hence too the head part that is fixed relative to the main part, in his hand. Hence, there is with the known hair trimmer a danger that the toothed cutting mechanism and the comb device may be held in an unsatisfactory position relative to the body part to which care is to be applied, as a result of which it may happen that, when hair is being trimmed, hairs may be cut to widely differing lengths, which is undesirable and a disadvantage.

It is therefore an object of the invention to overcome the problems outlined above and to produce a better personal care apparatus.

To allow the above object to be achieved, features according to the invention are provided in a personal care apparatus according to the invention such that a personal care apparatus according to the invention may be characterized in the manner detailed below, namely:

A personal care apparatus having a main part and a head part, wherein the main part is designed to be held in one hand and has a region adjacent the head part, wherein the head part is connected to the main part in the said region of the main part that is adjacent the head part and is pivotable relative to the main part about an axis of pivot, wherein a personal care tool is provided on the head part, wherein loading means that act between the main part and the head part are provided, wherein the head part is pivotable by means of the loading means in synchronization with varying displacing forces that act on the head part in the course of a personal care process, and wherein the head part can be positioned by means of the loading means in a defined rest position relative to the main part when there are no displacing forces present.

What is achieved by the provision of the features according to the invention, in a simple and space-saving manner and with little cost and complication, is that, in a personal care process performed with a personal care apparatus according to the invention, the personal care tool of the personal care apparatus is able automatically to adjust its position relative to the region of a human being's body to which care is being applied, and thus to adjust to the contour of this region of the body, by constantly changing its relative position, as a result of which good results can always be obtained in terms of the personal care given. Another and particularly important advantage of a personal care apparatus according to the invention is that the head part, and consequently the personal care tool too that is provided on the head part, even though they are displaceable in synchronization with displacing forces when in use, are automatically moved back to a defined rest position, and are held in the rest position, in the event of their not being used. An advantage that this affords is that, each time a personal care process begins, the head part is in a defined rest position to which a human being is accustomed, i.e. a starting position, relative to the main part, which is an advantage as far as accustomed and hence simple and convenient operation is concerned because the person using the personal care apparatus according to the invention can always begin from the same starting position when using the apparatus.

In a personal care apparatus according to the invention, the loading means may be formed by magnetically active loading means. It has, however, proved to be highly advantageous for the loading means to be formed by spring means. A simple and inexpensive solution can be achieved in this way.

In a personal care apparatus according to the invention as described in the previous paragraph, the spring means may be formed by, for example, a torsion spring or a coil spring. It has, however, proved particularly advantageous for the loading means to be formed by a spring of a U-shaped configuration that is connected to the main part in the region of its cross-member and that co-operates with at least one positioning extension connected to the main part in the region of each of its two sides. This provides a solution that is particularly simple and reliable and resistant to ageing.

A personal care apparatus according to the invention may be a razor or a pore-cleaning apparatus or a face brush or an apparatus for defoliating a person's skin. It has proved to be particularly advantageous if the personal care apparatus is formed by a hair-trimmer and the personal care tool is formed by a toothed cutting mechanism that has at least one drivable toothed blade. What is achieved in this way is that hair-cutting operations can be performed in a particularly accurate way and thus give resulting haircuts that are highly satisfactory.

In a personal care apparatus as described in the previous paragraph, it has proved to be particularly advantageous if a motor is provided to drive the drivable toothed blade and the motor is accommodated in the head part. What is advantageously achieved in this way is that, despite the pivotable manner in which the head part is connected to the main part, it is possible to manage with very simple drive means between the motor and the drivable toothed blade.

In a personal care apparatus formed by a hair-trimmer, it has proved to be very advantageous if the main part, when held in one hand, projects from the hand in a direction of projection and the axis of pivot extends substantially parallel to the direction of projection. This gives an ergonomically advantageous configuration. What is more, a configuration of this kind is also advantageous in respect of easy operation and good resulting haircuts.

These and other aspects of the invention are apparent from and will be elucidated with reference to the embodiments described hereinafter.

Figure 1:
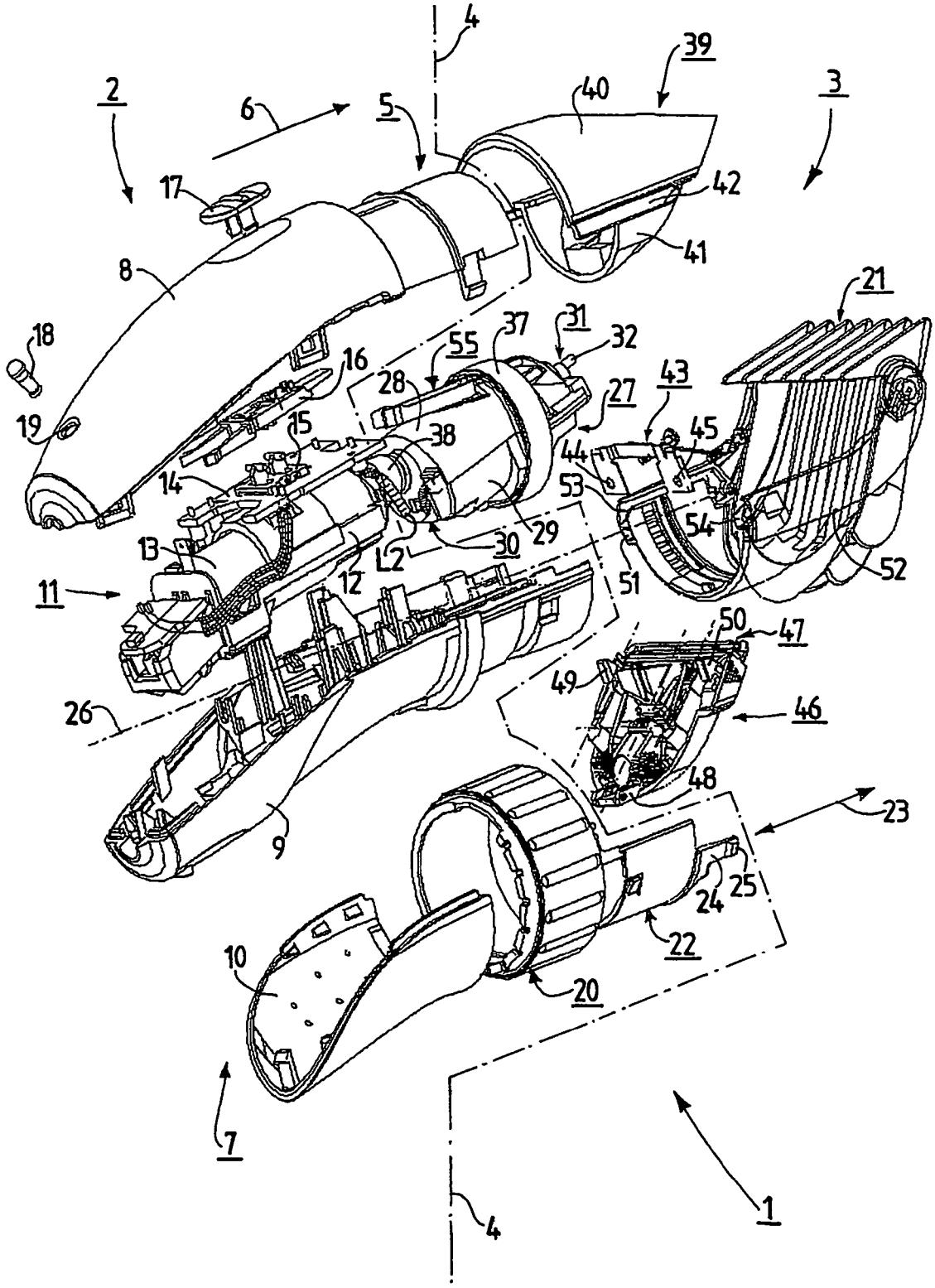
FIG. 1 is an exploded view showing a personal care apparatus according to one embodiment of the invention.
Figure 2:
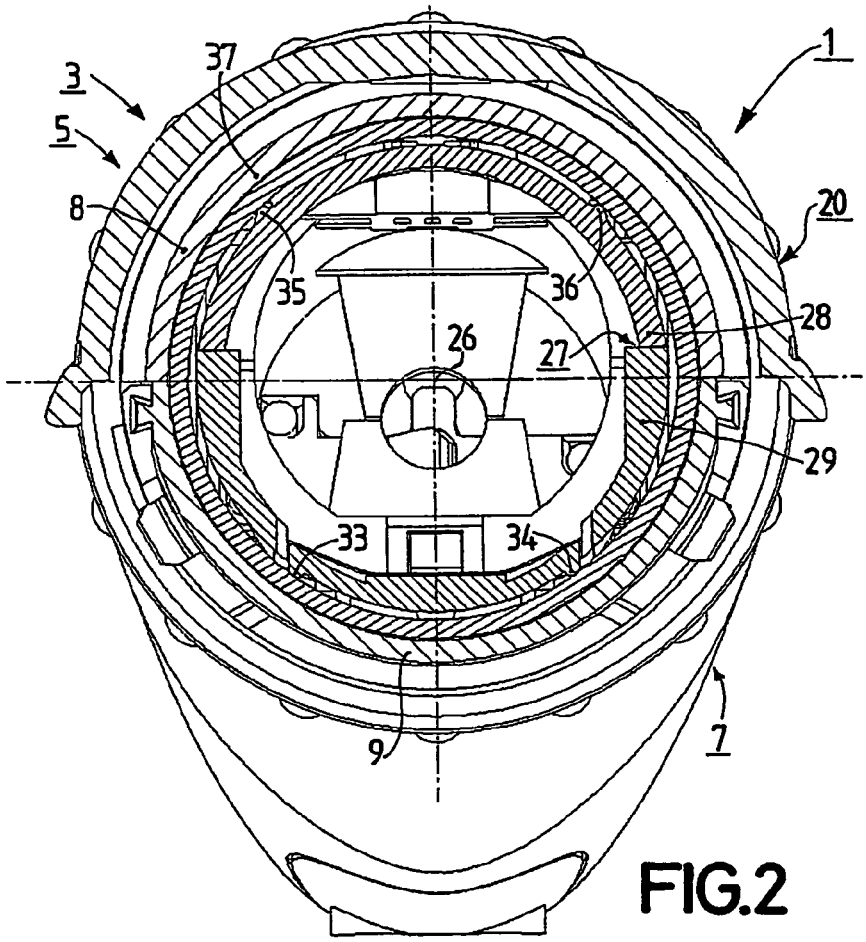
FIG. 2 is a cross-section through the personal care apparatus shown in FIG. 1.
Figure 3:
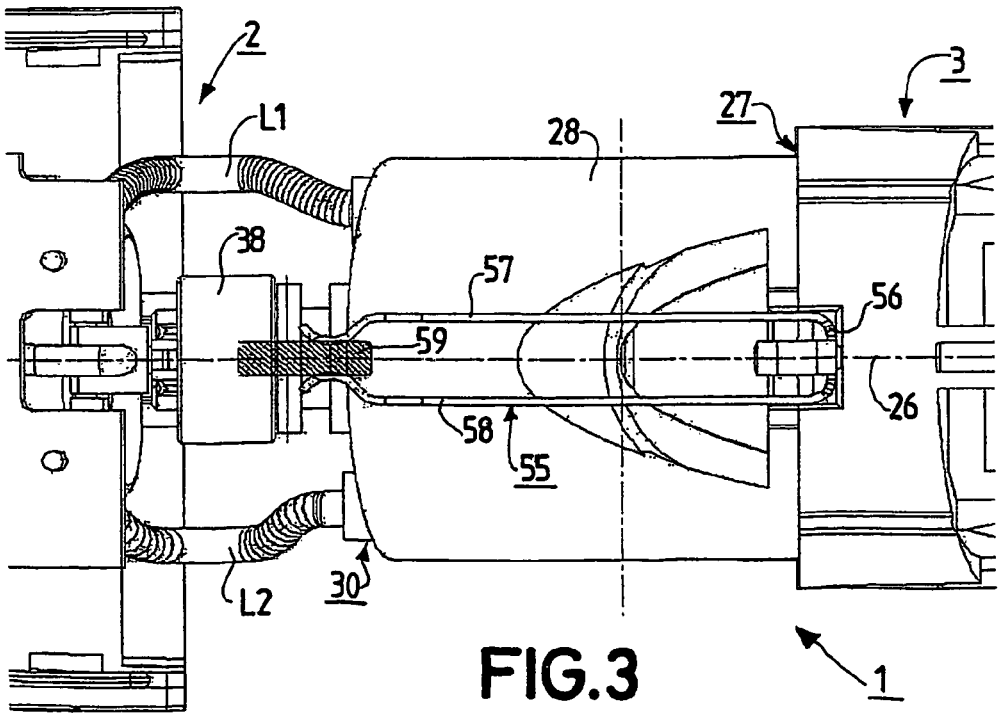
FIG. 3 is a plan view showing part of the personal care apparatus shown in FIGS. 1 and 2.

FIGS. 1 to 3 show a personal care apparatus 1 that is a hair-trimmer 1. The hair-trimmer 1 has a main part 2 and a head part 3. A boundary between the main part 2 and the head part 3 is indicated schematically in FIG. 1 by a dotted and dashed line 4.

The main part 2 is designed to be held in a hand (not shown). When so held in a hand, a region 5 of the main part 2 that is adjacent the head part 3 projects from the hand in a direction of projection 6 indicated by an arrow. The main part 2 has a housing 7. In essence, the housing 7 comprises a housing top section 8 and a housing bottom section 9 and a cover member 10 connected to the housing bottom section 9. Housed in the housing 7 is a power supply unit 11 to supply power to a motor. The power supply unit 11 has a battery holder 12 in which a battery 13, which is rechargeable in the present case, is securely held. Connected to the battery holder 12 is a printed-circuit board 14 on which is mounted a switch 15 for switching the hair-trimmer 1 on and off. Co-operating with the switch 15 is a slider 16 that is displaceably guided in the housing top section 8. Connected to the slider 16 is a sliding button 17. The sliding button 17 is accessible from outside the housing top section 8 and is movable to and fro in its longitudinal direction between two operating positions to enable the hair-trimmer 1 to be switched on and off. Also provided on the power supply unit 11 is an LED 18. By means of the LED 18, it is possible for a charging operation being performed on the rechargeable battery 13 of the hair-trimmer 1 to be indicated visually through an opening 19 in the housing top section 8.

Mounted on the housing 7 is an adjusting ring 20. The adjusting ring 20 is rotatable relative to the housing 7. The adjusting ring 20 is intended for adjusting a comb device 21 that belongs to the head part 3 and that will be considered in more detail below. Patent EP 0 325 326 B1, the disclosure of which is hereby incorporated by reference, may be consulted in this connection. A comb holder 22 co-operates with the adjusting ring 20. The comb holder 22 is displaceably guided in the housing bottom section 9 parallel to the direction indicated by the double-headed arrow 23. Provided between the adjusting ring 20 and the comb holder 22 is a slotted interengagement mechanism that cannot be seen in FIG. 1 and that has two slots extending in helical lines provided in the adjusting ring 20 and two sliding interengagement pins which project from the comb holder 22 and project into respective ones of the slots in the adjusting ring 20. At its free end opposite from the adjusting ring 20, the comb holder 22 has two extensions 24 from each of which a projection 25 projects sideways. Only one extension 24 and its projection 25 can be seen in FIG. 1. A mechanical connection to the comb device 21 is obtained by means of the projection 25, and this too will be considered in more detail below.

The head part 3 is connected to the main part 2 in that region 5 of the main part 2 that is adjacent the head part 3. The head part 3 can be pivoted relative to the main part 2 about an axis of pivot 26 in this case. The axis of pivot 26 is indicated in each of FIGS. 1 to 3 by a dotted and dashed line. In the present case, the axis of pivot 26 extends exactly parallel to the direction of projection 6 and exactly parallel to the main longitudinal direction of the hair-trimmer 1. This need not necessarily be the case because the direction of projection 6 and the direction of the axis of pivot 26 need not necessarily extend parallel to one another but may extend at an inclination to one another, in which case the angle of inclination may be 5° or 10° for example.

The head part 3 contains a motor mounting 27 that, as can clearly be seen from FIG. 2, comprises a motor-mounting top section 28 and a motor-mounting bottom section 29. Housed in the motor mounting 27 is a motor 30 that has an electrically conductive connection to the power supply unit 11 via two connecting wires L1 and L2. Connected to be solid in rotation with the shaft of the motor 30, which shaft cannot be seen in FIGS. 1 to 3, is an eccentric device 31 (see FIG. 1) that has an eccentric pin 32 by means of which a drivable blade belonging to a toothed cutting mechanism of the hair-trimmer 1 can be driven to reciprocate, an arrangement that has long been known.

The motor-mounting bottom section 29 has on its outer defining face a first supporting ridge 33 and a second supporting ridge 34. The two supporting ridges 33 and 34 are designed to be elastically yielding, i.e. resilient, in this case, which is achieved by selecting a suitable material for the motor-mounting bottom section 29. The motor-mounting top section 28 has a third supporting ridge 35 and a fourth supporting ridge 36. The two supporting ridges 35 and 36 are designed to be stiff, which is achieved by selecting a suitable material for the motor-mounting top section 28. All four supporting ridges 33, 34, 35 and 36 extend in the same direction as the axis of pivot 26. Co-operating with the four supporting ridges 33, 34, 35 and 36 is a first bearing ring 37, doing so in such a way that the motor-mounting top section 28 and the motor-mounting bottom section 29, and thus the entire motor mounting 27, are rotatable relative to the first bearing ring 37. The first bearing ring 37 is held immobile in the housing top section 8 and in the housing bottom section 9, in such a way that it is unable to perform any rotary or pivoting movements. The motor mounting 27 is also connected to a second bearing ring 38. The second bearing ring 38 is rotatably held in two half-bearing-shells that cannot be seen in FIGS. 1 to 3, one half-bearing-shell being provided in the housing top section 8 and the other half-bearing-shell being provided in the housing bottom section 9.

By means of the four supporting ridges 33, 34, 35 and 36 on the motor-mounting bottom section 29 and the motor-mounting top section 38 and the first bearing ring 37, and by means of the second bearing ring 38 and the half-bearing-shells that co-operate with the said second bearing ring 38, the motor mounting 27 is mounted to be rotatable relative to the main part 2, thus enabling the motor mounting 27 to be rotatable relative to the main part 2 about the axis of pivot 26 and consequently to be rotatable to and fro.

Fitted onto the motor mounting 27 is an end-housing 39. The end-housing 39 comprises a first housing section 40 and a second housing section 41, which are connected together. The first housing section 40 has two guide strips 42. Only one of these two guide strips 42 can be seen in FIG. 1. The two guide strips 42 project from the first housing section 40 and are used to guide the comb device 21, a process that will be considered in more detail below. The end-housing 39 may equally well comprise only a single housing section.

A tool holder 43 is fitted onto the end-housing 39 fitted onto the motor mounting 27 and is fastened to the motor mounting 27 by means of two screws (not shown) that pass through respective ones of two holes 44 and 45 in the tool holder 43, the tool holder 43 clipping into place as it is fastened in position a portion of the end-housing 39. The tool holder 43 is used to hold a tool belonging to the hair-trimmer but this will be considered in more detail below.

The hair-trimmer 1 has a cutting unit 46. The cutting unit 46 is fitted with a toothed cutting mechanism 47 that in the present case is intended to serve as a personal care tool and that has a stationary toothed blade and a toothed blade that can be driven by means of the motor 30, and by means of the toothed cutting mechanism 47 hair to be cut can be trimmed, i.e. shortened. The cutting unit 46 has a mounting arm 48 that can be pivotably connected to the end-housing 39. Once the mounting arm 48 has been pivotably connected to the end-housing 39, the cutting unit 46 is pivoted towards the end-housing 39, the cutting unit 46 then being latched into connection with the tool holder 46 by means of latching hooks 49 and 50, thus enabling the tool holder 43 to perform its function of holding the cutting unit 46.

The hair-trimmer 1 also has the comb device 21 that was mentioned above. In the present connection, all that will be said with regard to the comb device 21 is that the comb device 21 has two connecting arms 51 and 52, there being respective guide grooves 53 and 54 provided in connecting arms 51 and 52. A guide strip 42 on the first housing section 40 projects into each of the two guide grooves 53 and 54. By means of the guide strips 42 and the guide grooves 53 and 54, the comb device is guided to be adjustable back and forth parallel to the direction indicated by axis of pivot 26.

Due to the fact that in the hair-trimmer 1 the end-housing 39, the tool holder 43 and the cutting unit 46 are solidly connected to the rotatably mounted motor mounting 27, it becomes possible for the end-housing 39, the tool holder 43 and the cuffing unit 46 to be mounted and pivotable about the axis of pivot 26. For this reason, it needs to be ensured in the hair-trimmer 1 that the comb device 21 too can be pivoted about the axis of pivot 26, even though the said comb device 21 is connected to the comb holder 22, which is adjustable solely in the direction indicated by the double-headed arrow 23, i.e. parallel to the axis of pivot 26. To enable the comb device 21 to pivot in this way, the projections 25 on the comb holder 22 co-operate with two slots extending perpendicularly to the axis of pivot 26, which slots cannot be seen in FIGS. 1 to 3 but are provided in the comb device 21 and, as a result of their configuration and the path they follow perpendicular to the axis of pivot 26, allow the comb device to pivot about the axis of pivot 26.

Loading means 55 that act between the main part 2 and the head part 3 are advantageously provided in the hair-trimmer 1. The loading means 55 ensure that a loading is constantly applied to the head part 3. By means of the loading means 55, this enables the head part 3 to be pivotable in synchronization with variable displacing forces that act on the head part 3 in the course of a personal care process, i.e. a hair-cutting operation, and to be positionable in a defined rest position relative to the main part 2, by means of the loading means 55, when there are no displacing forces present.

In the hair-trimmer 1, the loading means are formed by spring means, the loading means 55, i.e. the spring means, being formed by a spring having a U-shaped configuration, as can clearly be seen from FIG. 3. In the region of its cross-member 56, the spring 55 is connected to the head part 3, that is to say to the motor-mounting 27 in the head part 3. In the region of each of its two sides 57 and 58, the spring 55 co-operates with a positioning extension 59 connected to the main part 2. In the present case, the positioning extension 59 is formed by a positioning lug 59 that projects from the housing top section 8 into the interior of the housing and that is shown in FIG. 3.

What is advantageously achieved in the hair-trimmer 1 is that, when the hair-trimmer 1 is being operated, the comb device 21 and the toothed cutting mechanism 47 of the cutting unit 46 are at all times able to pivot in synchronization with displacing forces that, in the course of a hair-cutting operation, act on the comb device 21 and hence on the toothed cutting mechanism 47 and the entire head part 3, and are thus always able to assume an optimum position relative to the region of a human being's body to which care is to be applied, in which case, despite the fact that the comb device 21 and the toothed cutting mechanism 47 are freely displaceable about the axis of pivot 26, it is ensured that, when the hair-trimmer 1 is not being used, the comb device 21 and the toothed cutting mechanism 47 always assume a defined rest position, i.e. a starting position, relative to the main part 2, which is an advantage as far as accustomed and hence simple and convenient operation of the hair-trimmer 1 is concearned because the person using the hair-trimmer 1 can always begin from the same starting position when using the trimmer 1.

In the personal care apparatus 1 described above which is formed by a hair-trimmer 1, the main longitudinal direction of the apparatus and the axis of pivot 26 extend exactly parallel to one another. It should be mentioned that this need not necessarily be the case and that in a personal care apparatus according to the invention the main longitudinal direction of the personal care apparatus, and hence the main longitudinal direction of the main part, and the direction of the axis of pivot about which the head part is pivotable, may also extend perpendicularly to one another, or may even make an angle of between 0° and 90° with one another.

The invention claimed is:

1. A personal care apparatus, comprising:

a hair trimmer;

a main part and a head part, the main part being adapted to be held in one hand and having a region adjacent the head part, wherein the head part is connected to the main part in the region of the main part that is adjacent the head part and the entire head part is pivotable relative to the main part about an axis of pivot;

a personal care tool provided on the head part and comprising a tooth cutting mechanism that has at least one drivable toothed blade driven by a motor provided in a housing of the head part;

a spring of a U-shaped configuration has a cross-member connected to the head part and two sides having distal ends bent inwards co-operating with at least one position extension connected to the main part in the region of each of its two sides, wherein the spring acts between the head part and the main part, and the head part is pivotable by the spring in synchronization with varying displacing forces that act on the head part in the course of a personal care process, and wherein the head part is adapted for positioning by the spring in a defined rest position relative to the main part when there are no displacing forces present.

2. A personal care apparatus as claimed in claim 1, wherein the main part, when held in one hand, projects from the hand in a direction of projection, and wherein the axis of pivot extends substantially parallel to the direction of projection.

* * * * *